US012773756B2

(12) United States Patent
Huang et al.

(10) Patent No.: US 12,773,756 B2
(45) Date of Patent: Oct. 27, 2026

(54) HIGH PERFORMANCE CMP MULTIDISK APPARATUS

(71) Applicant: Applied Materials, Inc., Santa Clara, CA (US)

(72) Inventors: Nai-Chieh Huang, Mountain View, CA (US); Akshay Aravindan, Sunnyvale, CA (US); Shih-Haur Shen, Sunnyvale, CA (US); Jianshe Tang, San Jose, CA (US); Jay Gurusamy, Santa Clara, CA (US); Chen-Wei Chang, San Jose, CA (US); Chih-Han Yang, Emeryville, CA (US); Wei Lu, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 357 days.

(21) Appl. No.: 18/483,070

(22) Filed: Oct. 9, 2023

(65) Prior Publication Data

US 2025/0114908 A1 Apr. 10, 2025

(51) Int. Cl.
*B24B 53/017* (2012.01)

(52) U.S. Cl.
CPC ..... *B24B 53/017* (2013.01)

(58) Field of Classification Search
CPC ..... B24B 53/00; B24B 53/17; B24B 53/12; B24B 53/14
See application file for complete search history.

(56) References Cited

U.S. PATENT DOCUMENTS 6,595,831 B1 7/2003 Hirokawa et al.
9,308,623 B2 * 4/2016 Chen ..... B24B 53/017
(Continued)

FOREIGN PATENT DOCUMENTS

CN 101972988 A 2/2011
CN 103506940 A 1/2014
CN 113118969 A 7/2021
(Continued)

OTHER PUBLICATIONS

Taiwanese Application No. 113138455, Notice of Decision to Grant mailed on Nov. 3, 2025, 4 pages (2 pages of original document and 2 pages of English Translation).
(Continued)

*Primary Examiner* — Carlos A Rivera
(74) *Attorney, Agent, or Firm* — Kilpatrick Townsend & Stockton LLP

(57) ABSTRACT

A system may include a gimbal defining a plurality of pockets, where each pocket may include a first portion and a second portion that extends between the first portion and a base of the pocket. The second portion may have a greater diameter than the first portion. The system may include a plurality of conditioning disks, where each conditioning disk is seated within the first portion of a respective pocket. The system may include a plurality of gaskets, where each gasket is seated within the second portion of a respective pocket. The system may include a plurality o-rings, each o-ring disposed between a peripheral edge of one of the plurality of conditioning disks and a lateral wall of one of the plurality of pockets. The system may include a plurality of shoulder screws for coupling the gimbal with one of the plurality of gaskets and a conditioning disk.

11 Claims, 5 Drawing Sheets

(56) References Cited

U.S. PATENT DOCUMENTS

| | | | | |
|---|---|---|---|---|
| 2011/0223835 | A1 | 9/2011 | Duescher | |
| 2020/0130139 | A1* | 4/2020 | Huang | B24B 53/12 |

FOREIGN PATENT DOCUMENTS

| | | | |
|---|---|---|---|
| CN | 217641284 | U | 10/2022 |
| JP | 10217108 | A | 8/1998 |
| KR | 102057843 | B1 | 12/2019 |

OTHER PUBLICATIONS

International Application No. PCT/US2024/049790, International Search Report and Written Opinion mailed on Jan. 10, 2025, 11 pages.
Taiwanese Application No. 113138455, Office Action mailed on Jul. 28, 2025, 15 pages (1 page of English Translation and 14 pages of original copy).

* cited by examiner

HIGH PERFORMANCE CMP MULTIDISK APPARATUS

FIELD OF INVENTION

The present technology relates to semiconductor systems, processes, and equipment. More specifically, the present technology relates to the devices used to polish of films deposited on a substrate.

BACKGROUND

An integrated circuit is typically formed on a substrate by the sequential deposition of conductive, semiconductive, and/or insulative layers on a silicon wafer. A variety of fabrication processes use the planarization of a layer on the substrate between processing steps. For example, for certain applications, e.g., polishing of a metal layer to form vias, plugs, and/or lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one common method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. The abrasive polishing slurry is typically supplied to the surface of the polishing pad.

As the polishing pad is used in the CMP process, the polishing pad and its effectiveness may deteriorate. A CMP process using a worn polishing pad may therefore take longer than a CMP process using a new polishing pad. One solution may be to utilize a new polishing pad. This may be expensive and inefficient, however. Another solution may be to recondition the polishing pad. Current systems and methods may partially recondition a polishing pad, but may lack the proper contact between a conditioning disk and the polishing pad to effectively recondition the polishing pad. Therefore, there is a need to develop systems and methods of providing better contact between the conditioning disk and the polishing pad.

BRIEF SUMMARY

A system may include a gimbal defining a plurality of pockets, where each pocket may include a first portion and a second portion that extends between the first portion and a base of the pocket. The second portion may have a greater diameter than the first portion. The system may include a plurality of conditioning disks, where each conditioning disk of the plurality of conditioning disks is seated within the first portion of a respective pocket of the plurality of pockets. The system may include a plurality of gaskets, where each gasket is seated within the second portion of a respective one of the one or more pockets. The system may also include a plurality o-rings, where each o-ring is disposed between a peripheral edge of one of the plurality of conditioning disks and a lateral wall of one of the plurality of pockets. The system may include a plurality of shoulder screws, where each shoulder screw couples the gimbal with one of the plurality of gaskets and one of the plurality of conditioning disks.

In some embodiments, each gasket and each o-ring are compressible during a reconditioning process, allowing each of the plurality of conditioning disks to move within a respective one of the plurality of pockets. The o-ring may be pre-compressed prior to reconditioning process. Each conditioning disk may substantially fill a first section of a respective one of the plurality of pockets. The plurality of pockets may be arranged radially about a central axis of the gimbal. The plurality of pockets may also be arranged at regular intervals about a center axis of the gimbal base. Each of the plurality of conditioning disks may be able to move independently of any other conditioning disk. Each of the plurality of conditioning disks may include one or both of stainless steel and a diamond-containing material. The plurality of o-rings may include a chemically-resistant material. Each of the plurality of gaskets may include at least one of polyethylene foam and neoprene. Each of the plurality of conditioning disks may include a diameter in a range of 17 mm to 24 mm, inclusive.

A method of conditioning a polishing pad may include positioning a gimbal of a pad conditioning system over a polishing pad, the gimbal attached to a gimbal base with a plurality of conditioning disks, each disposed in a respective pocket of the gimbal base and in contact with the polishing pad. The method may include rotating the gimbal with respect to the polishing pad. The method may include reconditioning the polishing pad at least in part by removing material from the polishing pad by the conditioning disks.

In some embodiments an edge of at least one of the plurality conditioning disks can tilt relative to the respective pocket within a range of −1° to 1°, inclusive. One or more shoulder screws may move vertically relative to the gimbal base in response to movement of a respective conditioning disk. The gimbal base may include six conditioning disks arranged in six respective pockets disposed every 60 about a center axis of the gimbal base. Each of the conditioning disks may be characterized by a diameter within a range of 17 mm to 24 mm, inclusive.

A pad conditioning system may include a gimbal base. The system may include a gimbal supported by the gimbal base and may include six respective pockets disposed every 60 about a center of the gimbal. The system may include a conditioning disk disposed within a first respective pocket of the six respective pocket, where the conditioning disk is able to tilt within the first respective pocket in relation to the gimbal. In some embodiments, the conditioning disk may include diamond. The conditioning disk is attached to the gimbal via a shoulder screw. The conditioning disk may be characterized by a diameter within a range of 17 mm to 24 mm, inclusive.

Figure 1:
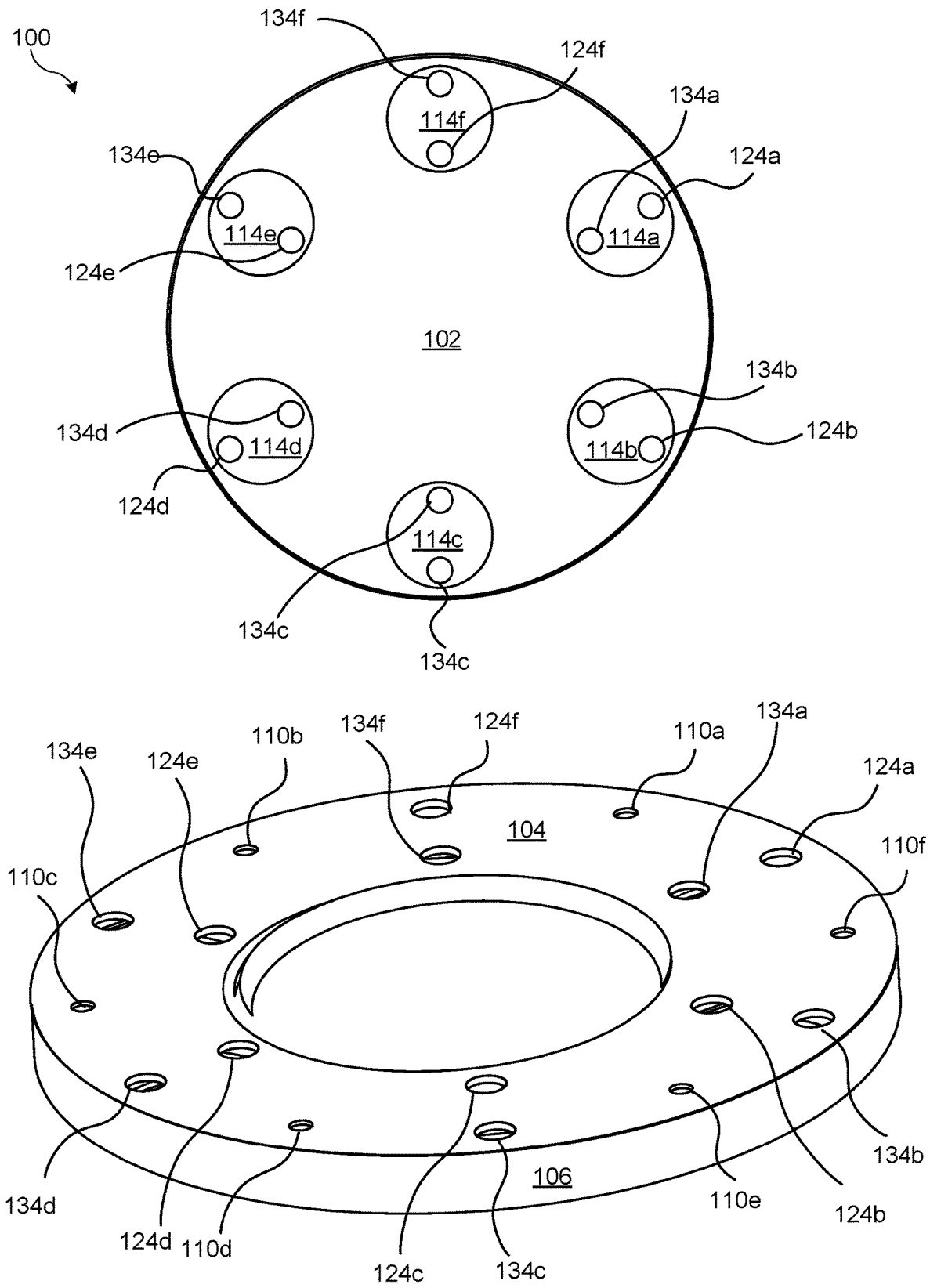
FIG. 1 illustrates a gimbal base with pockets, according to certain embodiments.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations and may include exaggerated material for illustrative purposes.

In the appended figures, similar components and/or features may have the same reference label. Further, various components of the same type may be distinguished by following the reference label by a letter that distinguishes among the similar components. If only the first reference label is used in the specification, the description applies to any one of the similar components having the same first reference label irrespective of the letter.

DETAILED DESCRIPTION

Chemical mechanical polishing (CMP) is a critical component of some semiconductor manufacturing processes. After a film is deposited on a substrate, a slurry including chemicals and an abrasive may be applied to the substrate. The slurry may then be used to polish the substrate by rotating a polishing pad while in contact with the substrate such that the chemicals and abrasives in the slurry remove material from the film and/or the substrate. The polishing pad may be manufactured from a fibrous material with an uneven surface. The uneven surface may assist in moving the slurry across the substrate as the polishing pad is rotated. During the CMP process, however, the polishing pad may wear or degrade. The surface of the polishing pad making contact with the substrate may become more smooth, and therefore no longer be as effective on moving the slurry across the substrate. Thus, a CMP process using a worn polishing pad may take longer and/or lead to an uneven polishing of the substrate causing inconsistencies in the final semiconductor product.

A worn polishing pad may be reconditioned however, to restore at least some of its previous performance. A reconditioning process may be performed on the worn polishing pad, such that the surface of the worn polishing pad is made more rough and therefore able to move slurry more effectively. During the reconditioning process, a gimbal may be positioned above the worn polishing pad. The gimbal may include one or more conditioning disks seated within the gimbal. The conditioning disks may be manufactured from stainless steel or another suitable metal and include a diamond-containing material on at least one surface of the conditioning disk. The gimbal may then be lowered and rotated such that the conditioning disks abrade the worn polishing pad. The gimbal may allow the entire system to pivot and tilt in response to any uneven wear of the worn polishing pad. However, as the gimbal tilts, one conditioning disk may apply more pressure than another conditioning disk. The difference in pressure may lead to hot and cold spots across the worn pad, as well as uneven reconditioning of the work polishing pad. Furthermore, As the gimbal tilts, a conditioning disk may apply uneven pressure across a diameter of the conditioning disk. For example, if the gimbal tilts towards a first direction (e.g., in response to a high spot of the worn polishing pad in a direction opposite the first direction), the conditioning disk may apply more pressure on an edge of the conditioning disk corresponding to the first direction than an edge corresponding to the opposite direction. This may lead to more hot and cold spots, as well as uneven wear to the conditioning disks.

To address these issues, a system may include a gimbal, supported by a gimbal base. The gimbal and/or the gimbal base may include a plurality of pockets (e.g., 3, 4, 6, etc.) arranged uniformly about a center of the gimbal. A conditioning disk may be disposed in a respective pocket of the plurality of pockets. A gasket may be disposed within the respective pocket between the gimbal and the conditioning disk. The gasket may be manufactured from rubber or another suitable material, such that the gasket may be compressed and return to an original shape of the gasket. An O-ring may be disposed within a channel about a circumference of the respective pocket. The O-ring may also be manufactured from rubber or another suitable material, such that the O-ring may be compressed and return to an original shape of the O-ring. The conditioning disk may be attached to the gimbal such that the conditioning disk may tilt and/or move within the pocket. As the gimbal tilts during a reconditioning process, the conditioning disk may also tilt (in relation to the respective pocket), maintaining more even pressure with the worn polishing pad. When the gimbal returns to a neutral position, the conditioning disk may also return to a neutral position (in relation to the respective pocket), again maintaining a more even pressure with the worn polishing pad. In other words, the conditioning disk may apply even pressure to the worn polishing pad throughout the reconditioning process, regardless of a position of the gimbal. Hot and cold spots of the worn polishing pad may therefore be reduced or minimized, and the conditioning disks may wear more evenly. Thus, a worn polishing pad may be reconditioned more efficiently.

FIG. 1 illustrates a gimbal base 100 with pockets 114*a-f*, according to certain embodiments. The gimbal base 100 may be a component of a pad conditioning system, used to recondition a worn polishing pad during a reconditioning process. The gimbal base 100 may include a bottom surface 102, a top surface 104 and a lateral surface 106. The bottom surface 102 may positioned towards the worn polishing pad during a reconditioning process. The top surface 104 may include holes 110*a-f*. The holes 110*a-f* may be configured to accept a screw or other such fastener to attach the gimbal base 100 to a gimbal. The lateral surface 106 may define a height of the gimbal base 100. The height may be within a range of 6 mm to 15 mm, inclusive.

The pockets 114*a-f* may be open at the bottom surface 102. The pockets 114*a-f* may be a concave volume defined in the gimbal base 100, with a depth equal to or less than the height of the gimbal base 100. For example, the pockets 114*a-f* may have a depth within a range of 5 mm to 14 mm, inclusive. Each pocket 114*a-f* may also include a diameter within a range of 18 mm to 25 mm, inclusive. Each of the pockets 114*a-f* may include mounting holes 124*a-f* and 134*a-f* that extend through the top surface 104. For example, the pocket 114*a* may include mounting holes 124*a-f* and 134*a-f*. Although each of the pockets 114*a-f* is shown with two mounting holes 124*a-f* and 134*a-f*, any number of mounting holes may be present (e.g., 3, 5, etc.). The mounting holes 124*a-f* and the 134*a-f* may be configured to accept shoulder screws, used to attach a conditioning disk to a gimbal and the gimbal base 100 such that the conditioning disk is disposed within a respective pocket of the pockets 114*a-f*. In some embodiments, the shoulder screws or other fasteners may be arranged linearly (or a single fastener may be used) to facilitate tilting of the conditioning disk during reconditioning operations.

The pockets 114*a-f* may be arranged at regular intervals about a center axis of the gimbal base 100. For example, the pockets 114*a-f* may be disposed every 60° degrees about the center axis of the gimbal base 100 at a constant radius. In other examples, the pockets 114*a-f* may be disposed every 60° at varied radii. In still other examples, there may only by three pockets, disposed every 120° at a constant or varied radii. Other numbers of pockets 114 may be provided in various embodiments.

Figure 2:
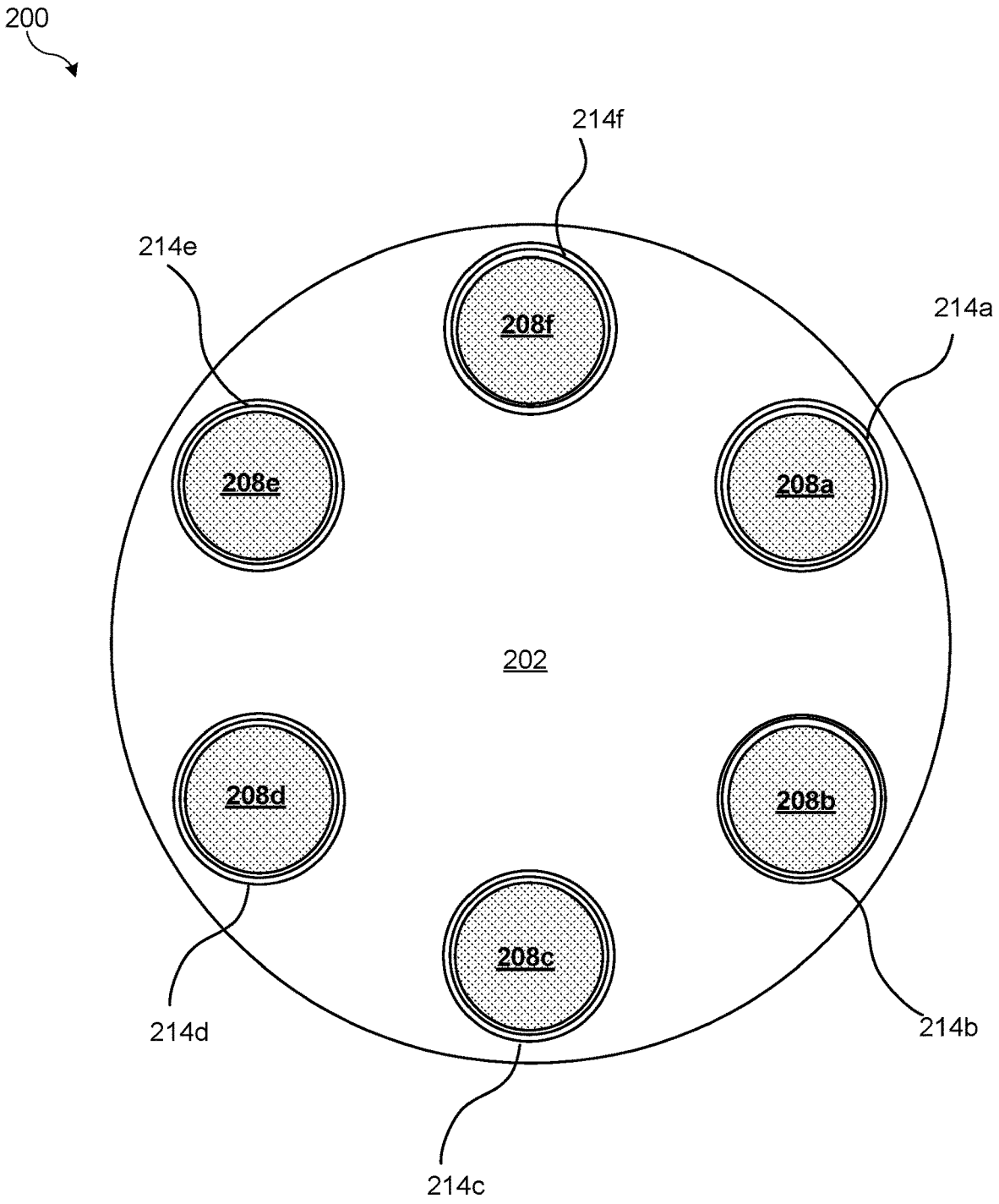
FIG. 2 illustrates a bottom view of a gimbal base with conditioning disks disposed in pockets.

FIG. 2 illustrates a bottom view of a gimbal base 200 with conditioning disks 208*a-f* disposed in pockets 214*a-f*. The gimbal base 200 may be similar to the gimbal base 100 in FIG. 1 and include similar features and functionalities. For example, the conditioning disks 208*a-f* may be attached to the gimbal base through mounting holes (e.g., the mounting holes 124*a-f* and 134*a-f*) within each of the pockets 214*a-f*. As above, each of the pockets 214*a-f* may include a diameter within a range of 18 mm to 25 mm. Accordingly, each of the conditioning disks 208*a-f* may include a diameter less than that of the pockets 214*a-f* (e.g., 17 mm to 24 mm, inclusive).

The conditioning disks 208*a-f* may be manufactured from stainless steel or any other suitable metal. A bottom surface of the conditioning disks 208 a-f corresponding to the bottom surface 204 of the gimbal base 200 may include a diamond-containing material. When used in a reconditioning process, the diamond-containing material may abrade a worn polishing pad such that the worn polishing pad becomes reconditioned.

Because the conditioning disks 208*a-f* are disposed in the pockets 214*a-f*, the conditioning disks 208*a-f* may be arranged radially about a center axis of the gimbal base 404. The conditioning disks 208*a-f* may also be arranged at regular intervals about the center axis of the gimbal base. For example, the conditioning disks 208*a-f* may be disposed every 60° degrees about the center axis of the gimbal base 100 at a constant radius. In other examples, the conditioning disks 208*a-f* may be disposed every 60° at varied radii. In still other examples, there may only by three pockets, disposed every 120° at a constant or varied radii. One of ordinary skill in the art would recognize many different possibilities and configurations.

Figure 3:
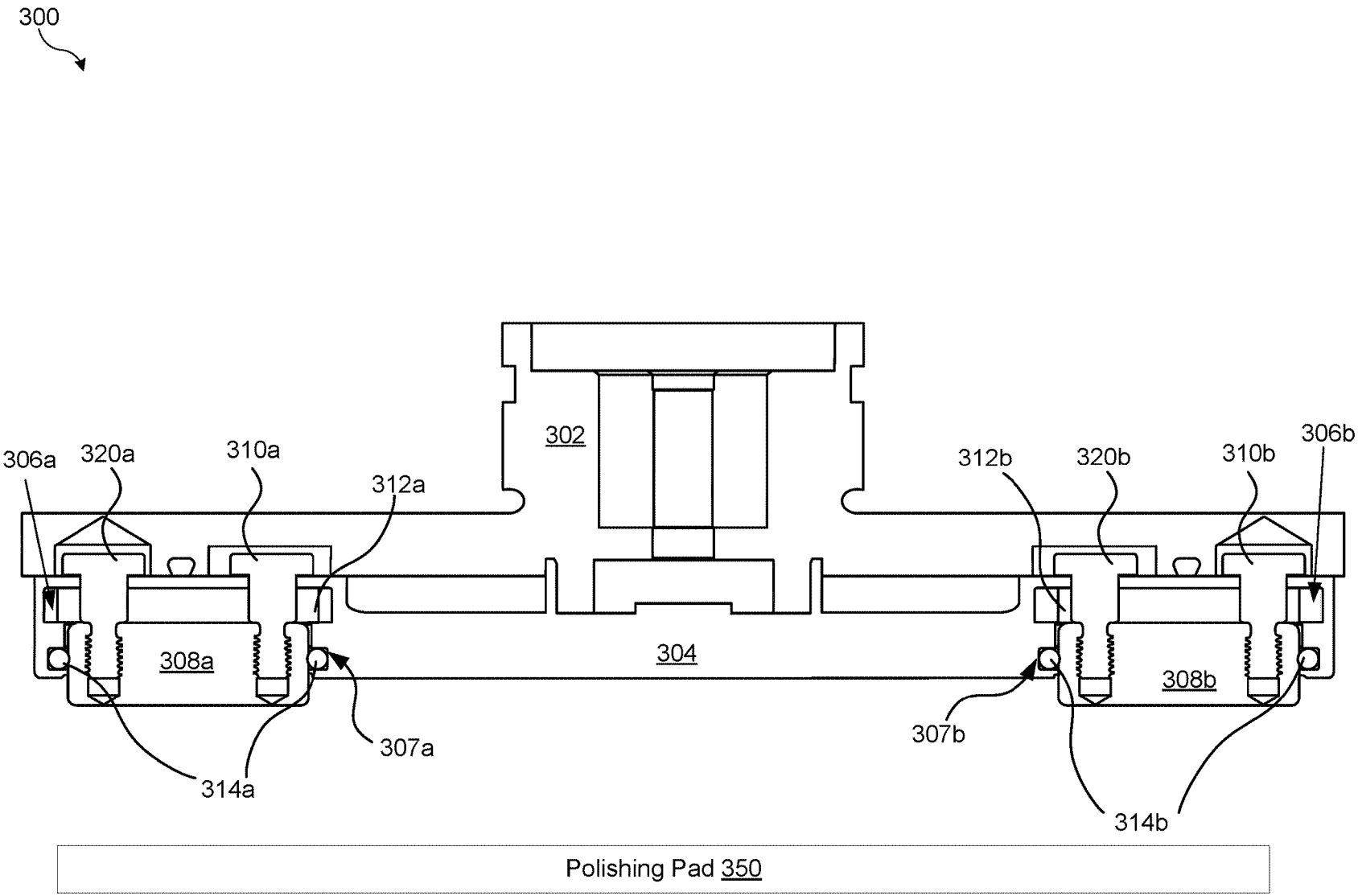
FIG. 3 illustrates a pad reconditioning system and a polishing pad, according to certain embodiments.

FIG. 3 illustrates a pad reconditioning system 300 and a polishing pad 350, according to certain embodiments. The pad reconditioning system may include a gimbal 302 and a gimbal base 304. The gimbal base 304 may be similar to the gimbal base 200 shown in FIG. 2. The gimbal 302 may be attached to the gimbal base 304 by one or more screws, bolts, or other such fasteners (e.g. via mounting holes 124*a-f* and 134*a-f* in FIG. 1). The gimbal base 304 may include pockets 306*a-b*. The pockets 306*a-b* may include a bottom section with a first radius and a top section with a second radius. The bottom section of each pocket 306*a-b* may be configured to house conditioning disks 308*a-b*, respectively. The first radius may therefore be larger than the radius of the respective conditioning disk 308*a-b*. The conditioning disks 308*a-b* may be manufactured from stainless steel and include one or more surfaces with a diamond containing material. The top sections of pockets 306*a-b* may be configured to house gaskets 312*a-b*. The second radius may be larger than the first radius, to allow the respective gasket 312 seated therein to expand laterally when compressed vertically. The conditioning disks 308*a-b* and the gaskets 312*a-b* may be attached to the gimbal 402 and/or the gimbal base 404 via shoulder screws 310*a* and 320*a*.

The bottom section of the pockets 306*a-b* may also include respective channels 307*a-b* about a circumference of the pockets 306*a-b*. For example, each channel 307*a-b* may be defined and/or otherwise formed within a radial or lateral sidewall of the respective pocket 306. Each of respective channels may house an o-ring 314*a-b*. The o-rings 314*a-b* may be made of a rubber containing material, polyethylene foam, polyurethan, or other suitable material. The o-rings 314*a-b* may be manufactured from a chemically resistant material. The o-rings 314*a-b* may be characterized by a hardness of between 60-80 durometer, inclusive. When seated into the channels 307*a-b*, the o-rings 314*a-b* may partially protrude into the pockets 306*a-b*, respectively. Thus, when the conditioning disks 308*a-b* are inserted into the pockets 306*a-b* as part of the manufacturing process, the o-rings 314*a-b* may be partially compressed. As the o-rings 314*a-b* may be partially compressed, lateral translation of the conditioning disks 308*a-b* may be limited or eliminated while preventing undue wear to the gimbal base 304 and/or the conditioning disks 308*a-b* via friction or other forces.

The gaskets 312*a-b* may be manufactured from a rubber containing material, polyethylene foam, vinyl foam, polyurethane, or any other suitable material. The gaskets 312*a-b* may be characterized, in part by a hardness value and or a compression ratio. For example, a rubber containing material may have a hardness value of between 5 and 40 durometer, inclusive.

In another example, a polyethylene foam may have a compression ratio of four pounds for 25% compression. Other compression ratios are also considered, (e.g., 4 lbs./30% compression, lbs./25% compression, 3 lbs./25% compression, etc.). In effect, the gaskets 312*a-b* may be manufactured from a material that allows the conditioning disks 308*a-b* to move vertically into the pockets 306*a-b*.

For example, during a reconditioning process, the conditioning disk 308*a* may be positioned such that a surface of the conditioning disk 308*a* is in contact with the polishing pad 350. During the reconditioning process, the conditioning disk may encounter a non-uniformity on the polishing pad 350. Due to the non-uniformity, the conditioning disk 308*a* may tilt or otherwise move within the pocket 306*a*. The gasket 312*a* may then compress. When the conditioning disk 308*a* is no longer encountering the non-uniformity of the polishing pad 350, the gasket 312*a* may expand, thereby forcing the conditioning disk back to an original position. Because each conditioning disk 308 can move independently, more even pressure may be applied by each conditioning disk 308, more efficiently reconditioning the polishing pad 350. Furthermore, because the conditioning disks 308*a-b* are in respective pockets 306*a-b*, movement of the conditioning disk 308*a* may not affect the movement of the conditioning disk 308*b*. In other words, each conditioning disk 308*a-b* may move independently of each other, allowing more even pressure to be applied by each conditioning disk 308*a-b* during the reconditioning process.

Figure 4A:
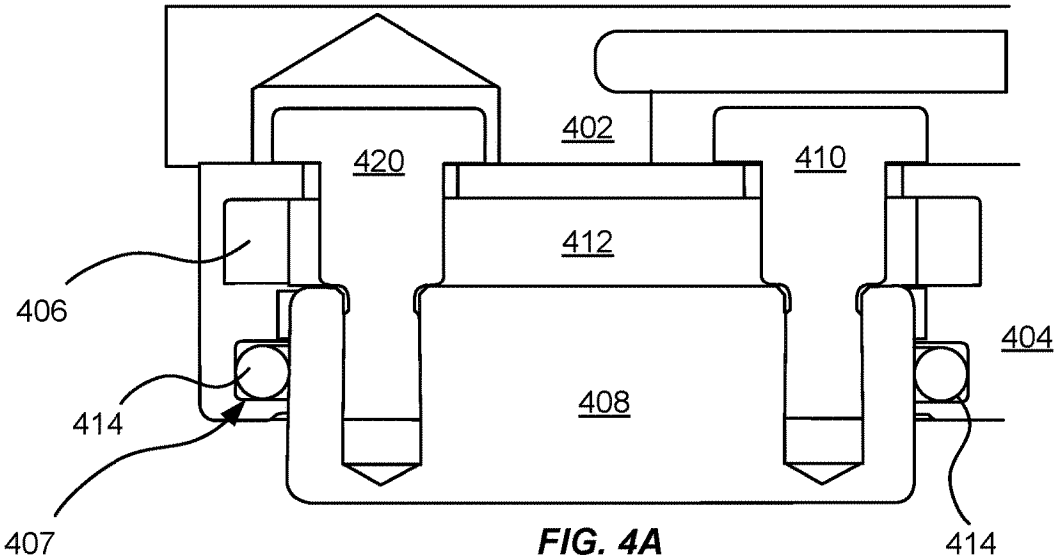
FIG. 4A illustrates a pad conditioning system with a conditioning pad in an original position, according to certain embodiments.
Figure 4B:
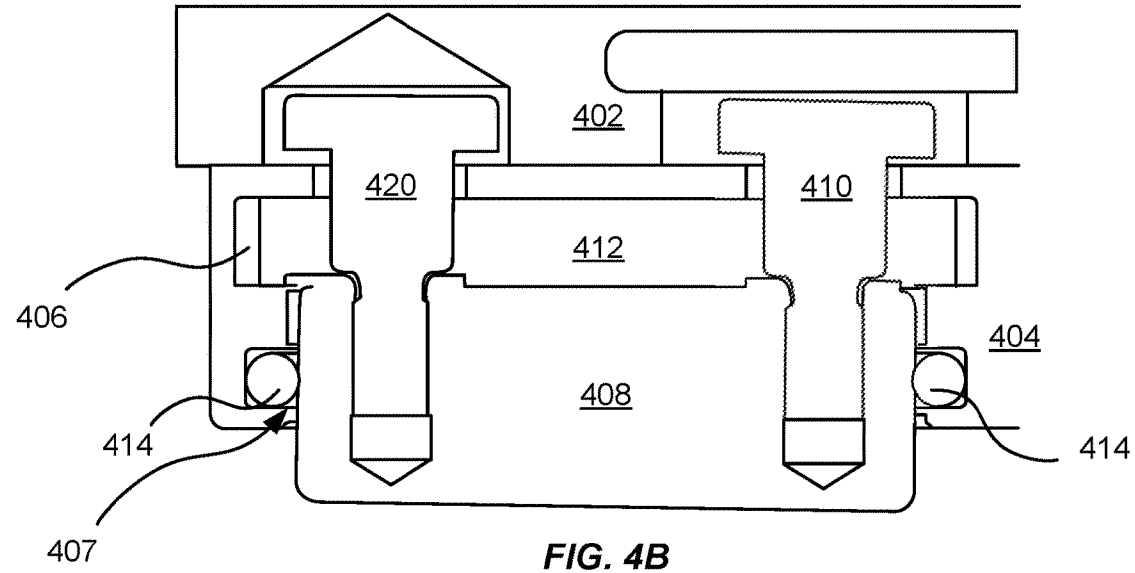
FIG. 4B illustrates 1 pad conditioning system with a conditioning disk in a second position, according to certain embodiments.

FIG. 4A illustrates a pad conditioning system 400 with a conditioning disk 408 in an original position, according to certain embodiments. FIG. 4B illustrates the pad conditioning system 400 with the conditioning disk 408 in a second position, according to certain embodiments. The pad conditioning system ("system") 400 may be similar to the system 300 described in relation to FIG. 3, and include similar components and functionalities. The system 400 may thus include a gimbal 402, a gimbal base 404, a pocket 406, and a channel 407. A conditioning disk 408 and a gasket 412 may be disposed within the pocket 406. An o-ring 414 may be disposed within the channel 407, such that a portion of the o-ring 414 protrudes into the pocket 406. The conditioning disk 408 and the gasket 412 may be attached to the gimbal 402 and/or the gimbal base 404 via shoulder screws 410 and 420. The shoulder screws 410 and 420 may be allowed to move vertically in response to movement by the conditioning disk 408.

In FIG. 4A, the conditioning disk 408 may be in an original position. The conditioning disk 408 may protrude from the pocket 406 by a distance within a range of 1 mm-4 mm, inclusive. A surface of the conditioning disk 408 that protrudes from the pocket 406 may include a diamond-containing material. During a reconditioning process, the surface including the diamond-containing material may be in contact with a polishing pad (e.g., the polishing pad 350 in FIG. 3) and abrade the polishing pad such that the pad is reconditioned.

In the original position, the conditioning disk 408 may be substantially parallel to the gimbal base 404. The o-ring 414 may be pre-compressed as described above in relation to FIG. 3. The gasket 412 may also be pre-compressed (e.g., compressed to 5%, 10%, etc.). Thus, when pressure is applied to the conditioning disk 408 driving the conditioning disk into the pocket 406, the gasket 412 may provide some resistance.

In FIG. 4B, a left side of the conditioning disk 408 may be driven upwards into the pocket 406 (e.g., by a non-uniformity of a polishing pad, encountered during the reconditioning process). As the conditioning disk 408 is driven into the pocket 406, the gasket 412 may be vertically compressed. In response, the gasket 412 may expand laterally into the pocket 406. Also, the shoulder screw 420 may move vertically to accommodate the movement of the conditioning disk 408. The shoulder screw 410 may also move vertically (or tilt) in response to the movement of the conditioning disk 408. When the conditioning disk 408 is no longer encountering the non-uniformity (e.g., the uniformity was been worn down or the conditioning disk 408 has moved to another part of the polishing pad), the gasket 412 may decompress, exerting force on the conditioning disk 408 such that the conditioning disk 408 returns to the original position.

Although FIG. 4B illustrates the conditioning disk 408 being tilted to the left, other movement may also be possible. For example, the conditioning disk 408 may tilt to the right, such that the shoulder screw 410 is elevated instead of the shoulder screw 420. The conditioning disk 408 may additionally or alternatively tilt to the front or back, and/or translate vertically in the pocket 406. The conditioning disk 408 may also move vertically, further compressing the o-ring 414. One of ordinary skill in the art would recognize many different possibilities and configurations.

Figure 5:
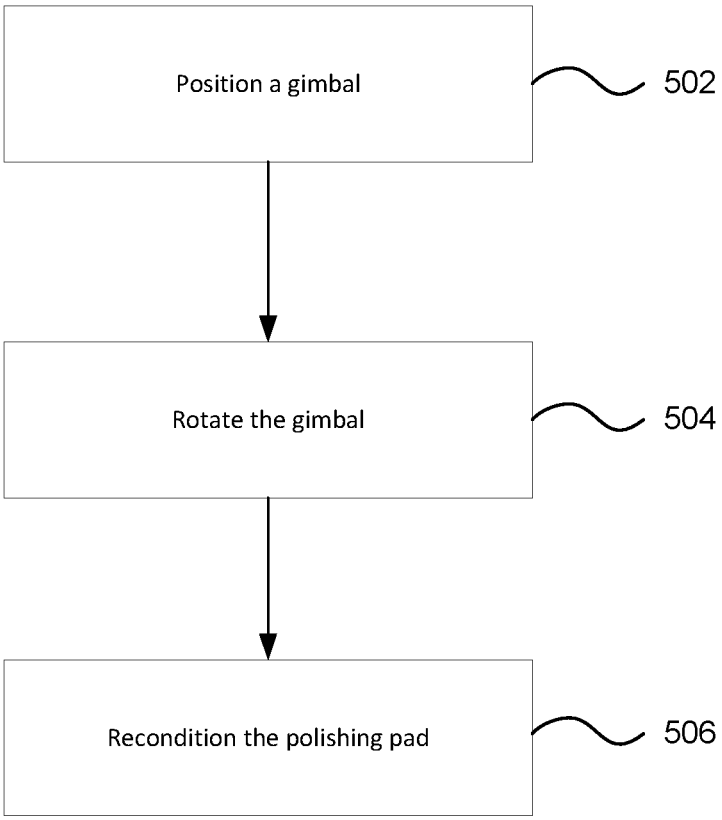
FIG. 5 illustrates a flowchart of a method for reconditioning a polishing pad, according to certain embodiments.

FIG. 5 illustrates a flowchart of a method 500 for reconditioning a polishing pad, according to certain embodiments. The method 500 may be performed by some or all of the systems and devices described herein, such as the system 300 in FIG. 3 and the system 400 FIG. 4. Some of the steps of the method 500 may be performed in a different order than is described, or may be combined with other steps. In some embodiments, some steps may be skipped altogether.

At step 502, the method 500 may include positioning a gimbal of a pad conditioning system (e.g., the system 300 in FIG. 3) over a polishing pad (e.g., the polishing pad 350). The gimbal may be attached to a gimbal base (e.g., the gimbal 402 and the gimbal base 404). The gimbal base may include a plurality of conditioning disks disposed in a respective pocket of the gimbal base. The conditioning disks may be in contact with the polishing pad. For example, a surface of the conditioning disks may include a diamond containing material. The surface may be in contact with the polishing pad.

In some embodiments, the gimbal base may include six conditioning disks arranged in six respective pockets. The six respective pockets may be disposed every 60° about a center axis of the gimbal base. The conditioning disks may be secured to the gimbal and/or the gimbal base via one or more shoulder screws. The one or more shoulder screws may move vertically relative to the gimbal base in response to movement of a conditioning disk. In some embodiments, the conditioning disks may be characterized by a diameter within a range of 17 mm-24 mm, inclusive.

At step 504, the method 500 may include rotating the gimbal relative to the polishing pad. Because the conditioning disks are disposed in pockets included in the gimbal base, the conditioning disks may also rotate relative to the polishing pad. Also, because each conditioning disk may move separately within a respective pocket (e.g., the system 400 in FIG. 4), each conditioning disk may provide more even pressure.

At step 506, the method 50 may include reconditioning the polishing pad at least in part by removing material from the polishing pad via the conditioning disks. For example, the diamond-containing material of the conditioning disk may be in contact with the polishing pad. As the conditioning disk is rotated on the surface of the polishing pad, material may be removed. Thus, a worn polishing pad may be roughened and better able to carry slurry during a CMP process.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Thus, for example, reference to "a heater" includes a plurality of such heaters, and reference to "the protrusion" includes reference to one or more protrusions and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. A system for conditioning a polishing pad, comprising:

a gimbal defining a plurality of pockets, wherein each pocket comprises a first portion and a second portion that extends between the first portion and a base of the pocket, wherein the second portion has a greater diameter than the first portion;

a plurality of conditioning disks, wherein each conditioning disk of the plurality of conditioning disks is seated within the first portion of a respective pocket of the plurality of pockets;

a plurality of gaskets, wherein each gasket is seated within the second portion of a respective one of the plurality of pockets;

a plurality of O-rings, wherein each O-ring is disposed between a peripheral edge of one of the plurality of conditioning disks and a lateral wall of one of the plurality of pockets; and a plurality of shoulder screws, wherein each shoulder screw couples the gimbal with one of the plurality of gaskets and one of the plurality of conditioning disks.

2. The system of claim 1, wherein each gasket and each O-ring are compressible during a reconditioning process, allowing each of the plurality of conditioning disks to move within a respective one of the plurality of pockets.

3. The system of claim 2, wherein the O-ring is pre-compressed prior to reconditioning process.

4. The system of claim 1, wherein each conditioning disk substantially fills a first section of a respective one of the plurality of pockets.

5. The system of claim 1, wherein the plurality of pockets are arranged radially about a central axis of the gimbal.

6. The system of claim 5, wherein the plurality of pockets are arranged at regular intervals about a center axis of a base of the gimbal.

7. The system of claim 1, wherein each of the plurality of conditioning disks is able to move independently of any other conditioning disk.

8. The system of claim 1, wherein each of the plurality of conditioning disks comprises one or both of stainless steel and a diamond-containing material.

9. The system of claim 1, wherein the plurality of O-rings comprises a chemically-resistant material.

10. The system of claim 1, wherein each of the plurality of gaskets comprises at least one of polyethylene foam and neoprene.

11. The system of claim 1, wherein each of the plurality of conditioning disks comprises a diameter in a range of 17 mm to 24 mm, inclusive.

* * * * *